US006435503B1

(12) United States Patent
Laughlin

(10) Patent No.: US 6,435,503 B1
(45) Date of Patent: Aug. 20, 2002

(54) JIGSAW PUZZLE BOX EASEL

(76) Inventor: George Eric Laughlin, 500 Victory Rd., Springfield, OH (US) 45504

( * ) Notice: Subject to any disclaimer, the term of this patent is extended or adjusted under 35 U.S.C. 154(b) by 0 days.

(21) Appl. No.: 09/713,057

(22) Filed: Nov. 16, 2000

(51) Int. Cl.[7] ..... A63F 9/10

(52) U.S. Cl. ..... 273/157 R; 273/148 R; 229/103

(58) Field of Search ..... 273/153 R, 157 R, 273/148 R, 309; 434/428, 429; 229/103, 116.1, 117.09, 199

(56) References Cited

U.S. PATENT DOCUMENTS 959,922 A * 5/1910 Cohn ..... 229/116.1
1,940,328 A * 12/1933 Schrotenboer ..... 229/103
3,171,540 A * 3/1965 Douglas ..... 273/157 R
3,433,485 A * 3/1969 Renn et al. ..... 273/157 R
4,761,008 A * 8/1988 Huggins ..... 273/148 R
4,943,063 A * 7/1990 Moreau ..... 273/157 R
4,948,139 A * 8/1990 Heeszel ..... 273/309
4,984,798 A * 1/1991 Silberstein ..... 273/157 R
6,213,465 B1 * 4/2001 Jacoby ..... 273/157 R

* cited by examiner

*Primary Examiner*—Steven Wong

(57) ABSTRACT

The top of a jigsaw puzzle box is propped at an angle for easy viewing by the person constructing the puzzle, by means of a simple and inexpensive easel attached to the underside of the box top, much like a framed photo is propped on a table or dresser. The easel is preferably attached to the inside of the box top at the time of manufacture and is ready to be used immediately after opening the box. It may, however, be free inside the box along with the puzzle pieces, and be adhered in the appropriate location by the purchaser just after opening the box. In addition, the easels may be sold as separate stand-alone items for attachment to existing puzzle boxes.

11 Claims, 1 Drawing Sheet

JIGSAW PUZZLE BOX EASEL

This invention relates specifically to a jigsaw puzzle box having a picture of the puzzle on the top side of the box and an easel on the inside of the box for holding the box at an incline or angle for viewing while assembling the puzzle pieces. It also relates to easels that are secured to the box or separate therefrom.

BACKGROUND OF THE INVENTION

Jigsaw puzzles are normally sold in rectangular boxes with the interlocking pieces unassembled. Purchase is frequently made on the basis of the picture on the outside top of the box, giving the purchaser a sense of the difficulty of constructing the puzzle as to colors and subject of the picture. This same picture is commonly used during puzzle construction to assist in its assembly. Many just lay the box top flat with the picture facing upwardly, while others may prop the top at an angle with a book, the upside down bottom of the box or some other means. Oftentimes, especially if the person working the puzzle is sitting at a table facing the construction area from the bottom of the puzzle, the angle of the box top may be such that its view leaves something to be desired.

SUMMARY OF THE INVENTION

The top of a jigsaw puzzle box is propped at an angle for easy viewing by the person constructing the puzzle, by means of a simple and inexpensive easel attached to the underside of the box top, much like a framed photo is propped on a table, shelf or dresser. The easel is preferably firmly attached to the inside of the box top at the time of manufacture and is ready to be used immediately after opening the box by merely moving the easel from an inoperative to an operative position. It may also, however, be free inside the box along with the puzzle pieces, and be made to adhere in the appropriate location by the purchaser just after opening the box. In addition, the easels may be sold as separate items for attachment to existing puzzle boxes or for use with puzzles sold without easels.

A principal object of the invention is to enable propping of a box top for a jigsaw puzzle at an appropriate angle by means of an easel, for ready viewing by a person working the puzzle.

A specific object is to provide an easel for accomplishing the aforesaid propping, which easel is of simple and inexpensive construction, adding very little to the end cost of the puzzle product.

Still another object is to provide such an easel either integral with the underside of the box at the time of sale to the end purchaser, freely carried in the box and attachable to the inside of the box top by the end purchaser, or sold as stand-alone or separate items for attachment to existing jigsaw puzzle boxes or boxes sold without an easel.

Other objects and advantages will be apparent from the following description in which reference is made to the accompany drawings.

DESCRIPTION OF THE PREFERRED EMBODIMENTS

Figure 1:
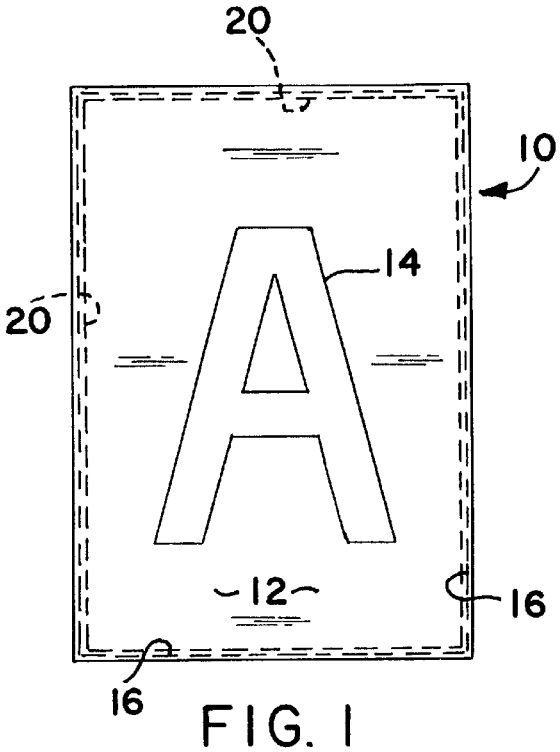
FIG. 1 is a plan view of the top of a jigsaw puzzle box with the letter "A" representing an upright picture.

FIG. 1 is a plan view or top of a rectangular puzzle box 10 having a face side or top 12 with a picture or pictorial representation 14 of a finished puzzle. The picture 14 is simply shown as the letter "A" in order to designate its upright position. The rectangular top 12 has the usual four depending side walls 16, the insides of which are shown as a rectangle in dotted lines.

Telescoping within the side walls 16 of the top 12 is a bottom of the box 10 that is constructed similarly to the top 12 and has the customary side walls 20 shown simply as a dotted rectangle. It should be understood that the bottom carries the unassembled puzzle pieces (not shown).

Figure 2:
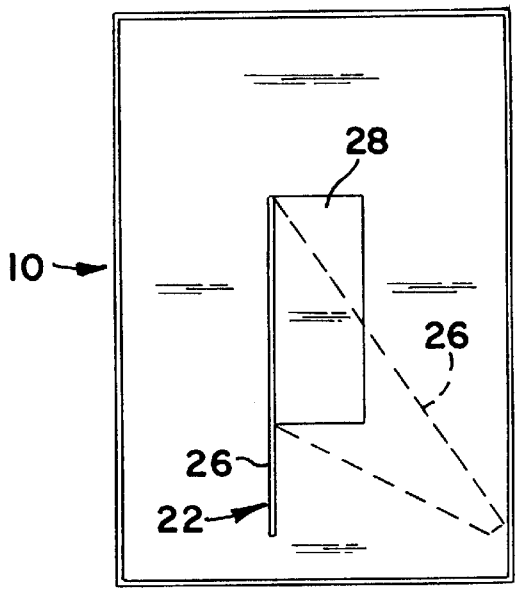
FIG. 2 is taken from the back of FIG. 1, showing an easel affixed to or integral with the underside (i.e., inside) of the box top.

The underside or inside of the box 10 is shown in plan view in FIG. 2 and has attached thereto, in the preferred form of the invention, a cardboard easel 22. A very simple and inexpensive form of design of the easel 22 is shown in a flat, open position in FIGS. 4 and 5 as it may be produced on a cutter and creaser. It is constructed from a flat sheet or roll of cardboard of recycled material similar to that of the box 10. It has a crease or score line 24 formed therein. The score line becomes a hinge enabling the easel 22 to be moved from an inoperative dotted-line position folded against the underside of the top 12 as shown in FIG. 2 to its full-line box-supporting position. In the latter position, a leg portion 26 of the easel stands perpendicularly relative to a first portion 28 and to the top 12 of the box. When so positioned, the easel 22 supports the box top 12 at an angle depicted in FIG. 2. The angle illustrated is 60 degrees, but may be any angle suitable to the person constructing the puzzle. Since the easel is made of flat cardboard, the end of the leg resting on a horizontal surface may even be trimmed with a scissors to reduce the box angle, or it may be stood more upright by adding to the length of the leg portion 26 either by gluing or stapling an additional piece of cardboard or resting the bottom of the leg portion 26 on a height spacer of some sort. While the angle of 60 degrees is preferred, it is not essential, and can vary according to the wishes of the puzzle worker or manufacturer.

Ideally, the easel would be contained with the puzzle and box as sold to the end user. It may be glued to the inside of the box top 12 with the leg portion folded well within the side walls of the top 12. When a person disassembles the puzzle after use and the box and puzzle are to be stored, the leg portion 26 is easily finger-tucked inside and may lay on top of the puzzle pieces.

Figure 3:
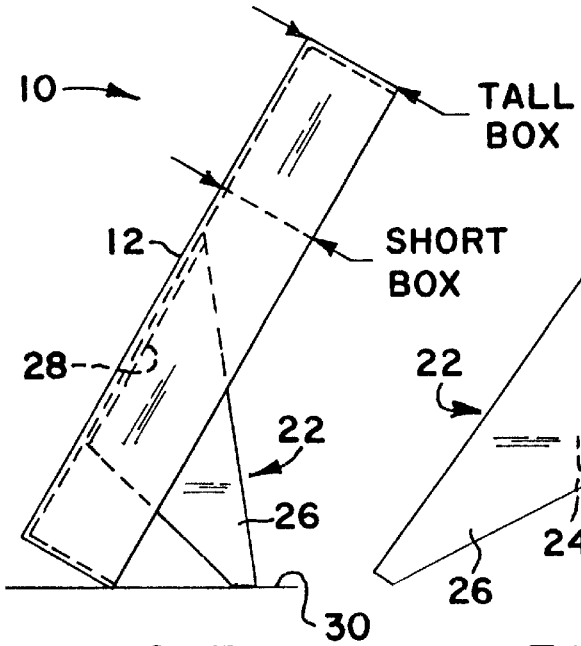
FIG. 3 is a side view of the box top with the easel in a position supporting the box top at an angle suitable for viewing by the person working the puzzle from the left side of the box.

FIG. 3 shows that the same easel construction can be used whether the long side of a rectangular box is upright as shown in FIG. 1, or a panorama picture may be lengthwise in the horizontal direction with the short dimension of the box being at the sides. This is illustrated by use of the legends "tall box" and "short box" in FIG. 3.

Figure 4:
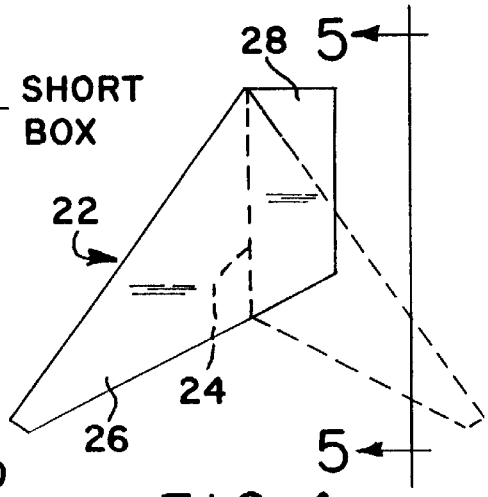
FIGS. 4 and 5 are face and side views respectively of a preferred simple cardboard form of easel that may be attached to any puzzle box.
Figure 5:
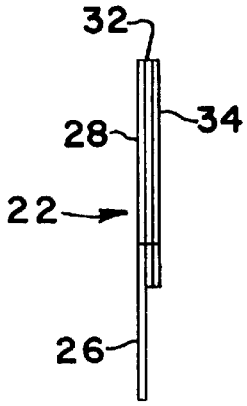

With what has been thus far described, it is apparent that the easel 22 need not be attached to the box top at the time of manufacture. It can be produced, for example, as shown in FIG. 5, with an adhesive 32 on the back of the first portion 28. Then, before the puzzle is first worked, a person would locate the easel according to location instructions and glue it to the inside. Also, for boxes not having easels, they can be sold in sets of several as independent, stand-alone products. If the adhesive is pressure-sensitive, a liner 34 would cover the adhesive until it is removed at the time it is to be attached. The shape of the easel in FIG. 4 is slightly different than that of FIGS. 1–3 for ease of manufacturing and savings of material.

Obviously, the box 10 can be shaped other than rectangular, provided there is a line (rather than a point) of contact between the bottom of the box and the surface on which it rests. The term rectangular as used herein is intended to also include any shape other than circular, oval or other shape where only a point of the box 10 contacts the surface 30.

Design changes may be made in the construction of the easel without departing from the spirit and scope of the claims.

Having described my invention, I claim:

1. In a rectangular jigsaw puzzle box with a lower section having a flat bottom and upstanding peripheral side walls for storing puzzle pieces therein whenever an associated puzzle is not under construction and further having a similarly-shaped upper section overfitting said lower section in telescoping fashion to enclose said box, said upper section having an upper exterior face portraying a pictorial representation of the completed puzzle when said pieces are assembled on a flat horizontal surface, said pictorial representation extending either lengthwise or widthwise of said box to correspond to the shape of the completed puzzle, the improvement comprising:

an easel having a first portion attachable to the inside of said upper section and a second leg portion hingedly interconnected to said first portion, said leg portion being adapted to be extended from a first position relatively flat and parallel to the inside of said upper section to a second position at an angle relative to said inside of said upper section whereby to enable said box to be propped relative to a flat horizontal surface at an angle approximately in the range of between 35 degrees and 85 degrees relative thereto; and said easel being so related to the pictorial representation of said puzzle whereby the pictorial representation is upright for easy angular viewing by a person assembling the puzzle.

2. A puzzle box according to claim 1 wherein the easel is unattached to but freely positioned in said box along with said puzzle pieces at the time of sale, and wherein said first portion can be attached to the inside of said upper section when ready to assemble the puzzle.

3. An easel for standing the upper flat-topped section of a rectangular jigsaw puzzle box having a pictorial representation of the finished puzzle in an upright angular position, said puzzle box storing puzzle pieces therein whenever said puzzle is not under construction, said easel being attachable to the inside surface of said upper section and, when attached thereto, extending angularly from said inside surface to present said pictorial representation for easy upright angular viewing by a person assembling the puzzle; said easel comprising:

a first flat portion attachable to the flat inside surface of said box upper section; and a second leg portion hingedly interconnected to said first portion, said leg portion being adapted, when said first portion is attached to the inside surface of said upper section, to be extended from a first position essentially parallel to said first portion to a second box-supporting position at an angle whereby to enable said box upper section to be propped relative to a flat horizontal surface on which a jigsaw puzzle is being assembled.

4. An easel according to claim 3 wherein said easel is produced from a flat piece of cardboard and wherein a score line is provided in said cardboard to form a hinge between said first portion and said leg portion.

5. An easel according to claim 3 wherein an adhesive is provided on said first flat portion on that side thereof which is attachable to said inside surface.

6. An easel according to claim 5 wherein said adhesive is pressure sensitive and wherein a removable cover liner is provided over said adhesive until such time as it is ready to be attached to said box.

7. An easel according to claim 6 wherein said easel is produced from a flat piece of cardboard and wherein a score line is provided in said cardboard to form a hinge between said first portion and said leg portion.

8. In a combination picture puzzle comprising a plurality of interlocking puzzle pieces, a container box having at least one flat exterior surface and a picture directly correlated to said picture puzzle on said exterior surface, said box serving to store said puzzle pieces before the puzzle is first assembled and thereafter between times when said puzzle pieces are constructed by one or more persons into an assembled puzzle, the improvement comprising:

an easel attached to a portion of said box in a location appropriate for propping the box with its exterior picture standing at an angle of rearward inclination facing said persons in an upright position for ease of their viewing during puzzle construction.

9. The combination picture puzzle according to claim 8 wherein said easel is initially and permanently attached to said box.

10. The combination picture puzzle according to claim 8 wherein said easel is originally separate from said box prior to first construction of said puzzle and thereafter permanently attached thereto.

11. The combination picture puzzle according to claim 8 wherein said box comprises a lower section and an upper section telescopingly fitting over said lower section, and wherein said easel is attached to the underside of said upper section, opposite said picture.

* * * * *